US009307311B2

(12) United States Patent
Tran

(10) Patent No.: US 9,307,311 B2
(45) Date of Patent: Apr. 5, 2016

(54) ADJUSTABLE EARPIECE DEVICE

(71) Applicant: MOTOROLA SOLUTIONS, INC, Schaumburg, IL (US)

(72) Inventor: Chi T. Tran, Weston, FL (US)

(73) Assignee: MOTOROLA SOLUTIONS, INC., Schaumburg, IL (US)

( * ) Notice: Subject to any disclaimer, the term of this patent is extended or adjusted under 35 U.S.C. 154(b) by 0 days.

(21) Appl. No.: 14/185,083

(22) Filed: Feb. 20, 2014

(65) Prior Publication Data

US 2015/0237433 A1 Aug. 20, 2015

(51) Int. Cl.
*H04R 1/10* (2006.01)

(52) U.S. Cl.
CPC ..... *H04R 1/10* (2013.01)

(58) Field of Classification Search
CPC .... H04R 1/1066; H04R 1/105; H04R 1/1016; H04R 1/1008; H04R 2201/107; H04R 5/033; H04R 5/0335
USPC ..... 381/330, 370, 374, 379, 381
See application file for complete search history.

(56) References Cited

U.S. PATENT DOCUMENTS

| | | | | |
|---|---|---|---|---|
| 6,427,018 | B1 | 7/2002 | Keliiliki | |
| D530,702 | S | 10/2006 | Pritchard et al. | |
| 2003/0002706 | A1* | 1/2003 | Keliiliki | 381/381 |
| 2010/0104125 | A1* | 4/2010 | Neu et al. | 381/381 |
| 2010/0183184 | A1* | 7/2010 | Milde et al. | 381/381 |

OTHER PUBLICATIONS

Motorola Solutions, Inc.—Lightweight Headsets—Extracted from: www.motorolasolutions.com/US-EN/Business+Product+and+Services/Accessories/Two-Way+Radio+Accessories/Audio+Accessories/Headsets/Lightweight+Headsets—Copyright 2014—pp. 3-6.

Motorola Solutions, Inc.—Medium Weight Headsets—Extracted from: www.motorolasolutions.com/US-EN/Business+Product+and+Services/Accessories/Two-Way+Radio+Accessories/Audio+Accessories/Headsets/Medium+Weight+Headsets—Copyright 2014—pp. 3-5.

Motorola Solutions, Inc.—Heavy Duty Headsets—Extracted from: www.motorolasolutions.com/US-EN/Business+Product+and+Services/Accessories/Two-Way+Radio+Accessories/Audio+Accessories/Headsets/Heavy+Duty+Headsets—Copyright 2014—pp. 3-5.

Corresponding International Application No. PCT/US2015/015104—International Search Report with Written Opinion, mailed May 4, 2015.

* cited by examiner

*Primary Examiner* — Brian Ensey
(74) *Attorney, Agent, or Firm* — Barbara R. Doutre

(57) ABSTRACT

An audio device (100) provides an on-ear speaker housing (110), an adjustable shaft (120), and a malleable ear loop (130) coupled to the adjustable shaft. The adjustable shaft (120) controls vertical movement of the malleable ear loop (130). The malleable ear loop (130) can be fit about a user's ear with its height being adjusted by the adjustable shaft 120. The adjustable shaft further controls rotation of the on-ear speaker housing (110). The rotation of the on-ear speaker housing (110) allows for user adjustable left ear mounting or right ear mounting with a single device.

22 Claims, 6 Drawing Sheets

400

ADJUSTABLE EARPIECE DEVICE

FIELD OF THE DISCLOSURE

The present disclosure relates generally to audio devices and more particularly to earpiece devices and more particularly to user-adjustable earpiece devices.

BACKGROUND

Today's communication environment offers a wide variety of user worn audio devices such as headphone, headset and earpiece devices. On-ear devices sit against the ear, near the ear canal, but not in the ear. There is a large variation in user ear sizes and shapes. An easily adjustable earpiece is highly desirable. Size and professional appearance are of concern to users. Customers also want devices that are easy to clean and sanitize. Reliability is a concern as tension on cables attached to an earpiece can lead to dislodgement of the earpiece from the user's ear. User preferences can change from left ear to right ear, an earpiece that adapts easily to both is needed. The ability of a user to adjust their own earpiece is critical in terms of comfort and good audio reception. Thus, it would be desirable to have a user friendly adjustable earpiece device.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
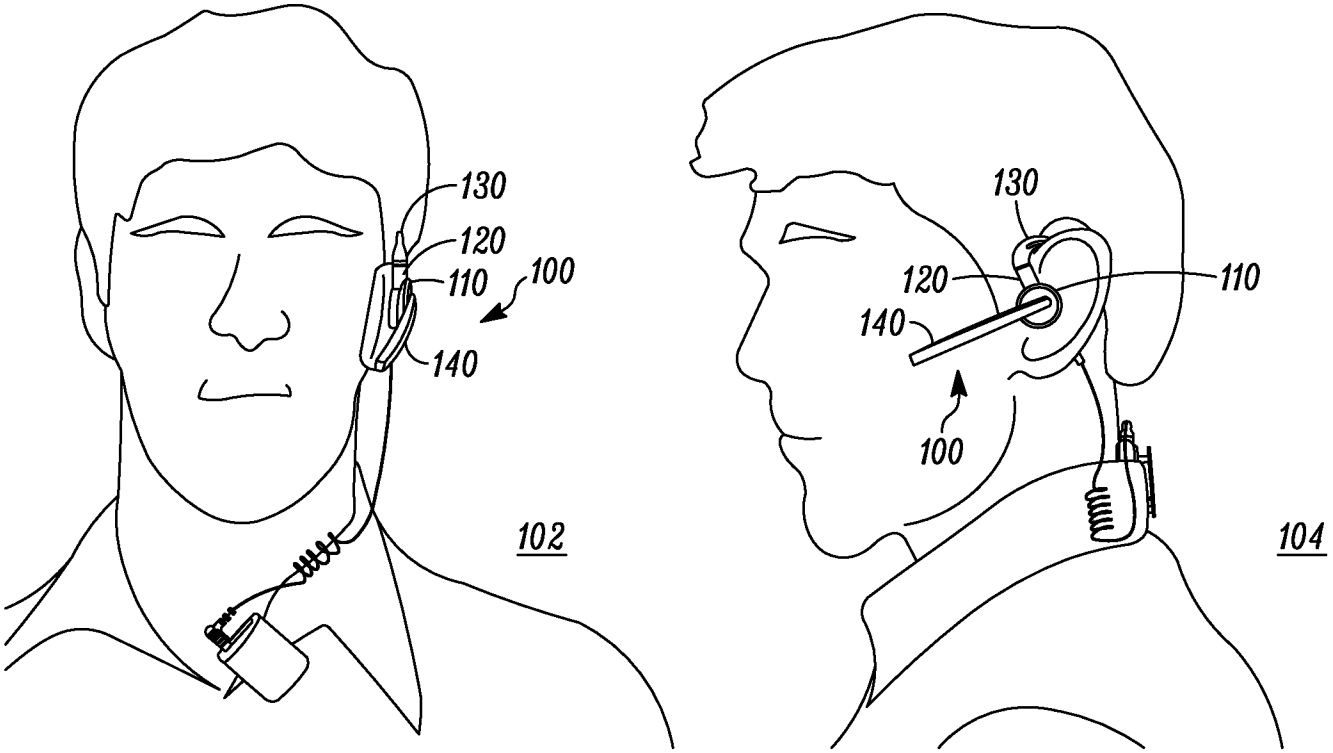
FIG. 1 is an earpiece device being worn by a user in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Briefly, there is provided herein an audio device comprising an earpiece which provides a plurality of adjustable features. A user can adjust the device for left ear or right ear usage by adjusting an adjustable shaft and a telescoping ear loop. The earpiece device may further comprise a swivel boom microphone which can equally be adjusted for right or left side operation. The pivoting boom microphone and telescoping ear loop provide additional adjustability for a wide variety of user preferences including user selectable right or left side operation.

FIG. 1 is a user worn audio device formed in accordance with some embodiments. The audio device 100 comprises an on-ear speaker housing 110 having inner and outer surfaces, an adjustable shaft 120 coupled to the on-ear speaker housing, and a malleable ear loop 130 coupled to the adjustable shaft. The audio device 100 may further comprise a swivel boom microphone 140 coupled to the outer surface of the on-ear speaker housing 110. As will be shown in subsequent views, this single audio device provides a plurality of adjustable features which allows a user to fully customize the fitting of the device for comfort and audio reception as well as left or right ear usage.

Figure 2:
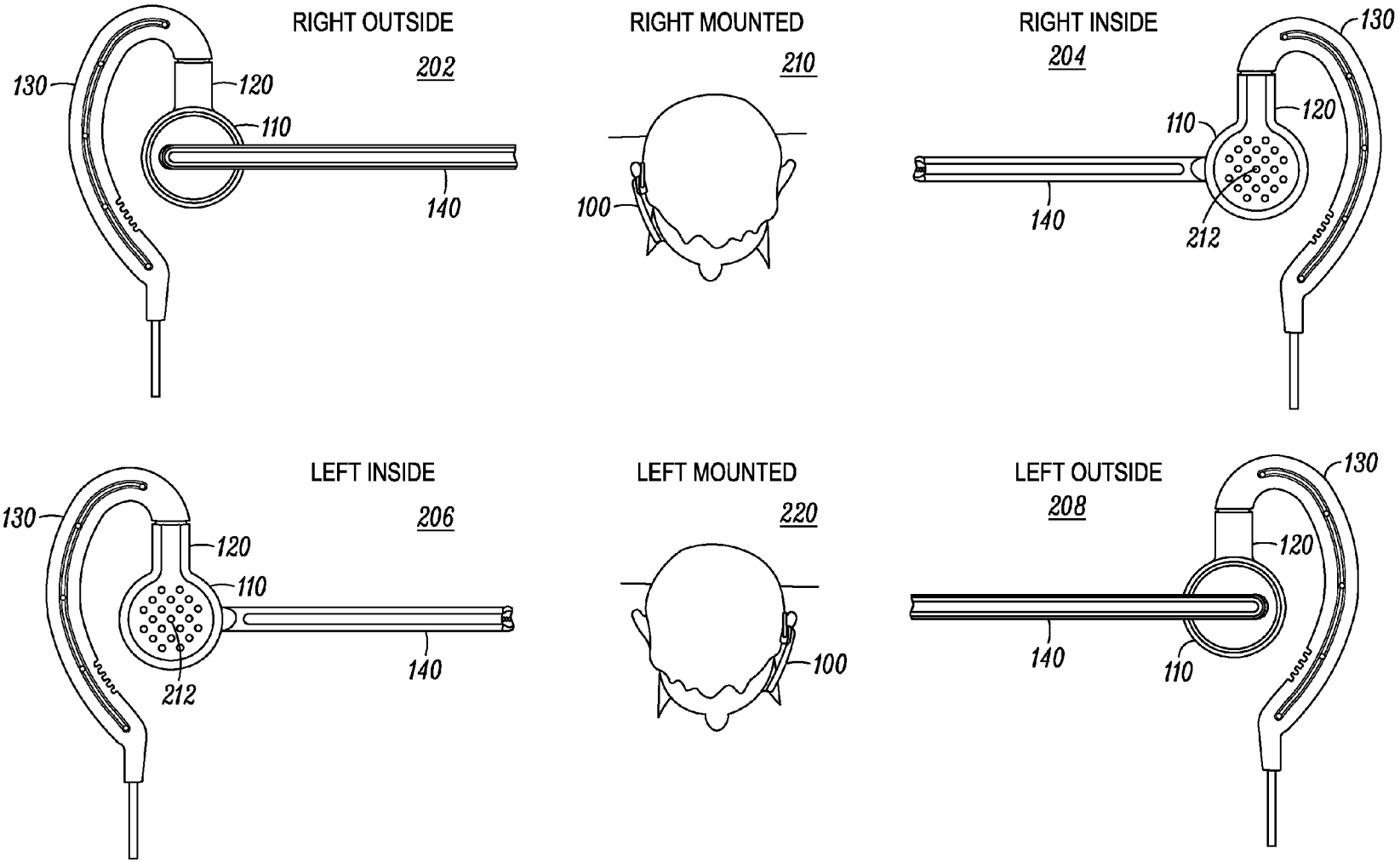
FIG. 2 shows right and left mounting positions of the earpiece device in accordance with some embodiments.

FIG. 2 shows right and left mounting positions of the audio device 100 in accordance with some embodiments. For the right ear mounting, view 202 shows a right outside position of the audio device having on-ear speaker housing 110, adjustable shaft 120, malleable ear loop 130, and boom microphone 140. View 210 shows the audio device 100 mounted to the right ear of a user. With this mounting, audio porting 212 located on the inner surface of the on-ear speaker housing 110 is located next to the user's right ear. View 204 shows the right inside position of the audio device 100.

For left ear mounting, view 206 shows a left inside position of the audio device 100 having on-ear speaker housing 110, adjustable shaft 120, malleable ear loop 130, and boom microphone 140. View 220 shows the audio device 100 mounted to the left ear of a user. With this mounting audio porting 212 is located next to the user's left ear. View 208 shows the left outside position of the audio device 100.

In accordance with the various embodiments, the adjustable shaft 120 is rotated to accommodate either left side or right side usage. The adjustable shaft 120 is formed as an extension of the on-ear speaker housing 110, preferably as a single molded piece part, within which the shaft pin 310 can be pulled up and down by pulling on the ear loop 130.

Figure 3:
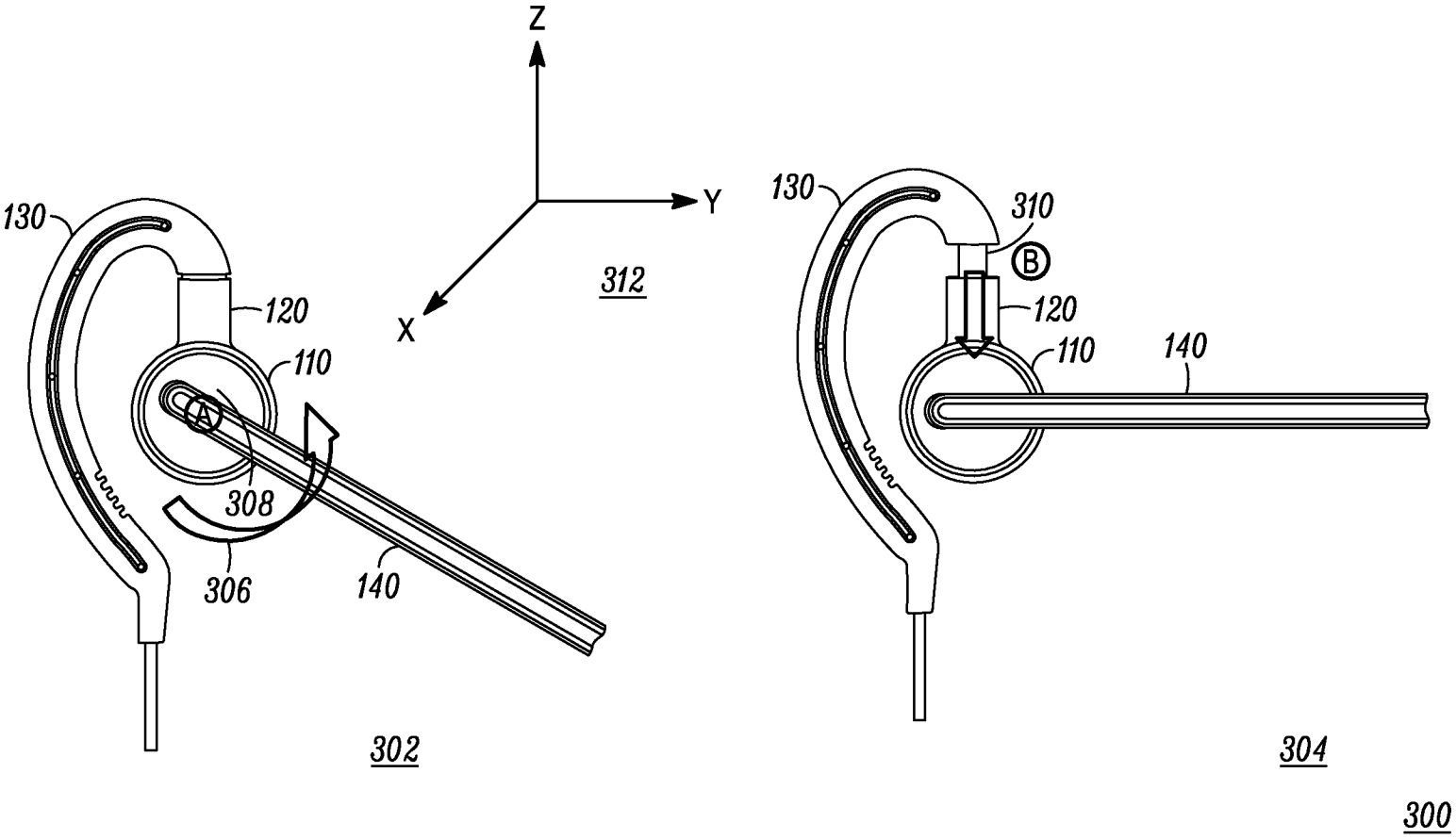
FIG. 3 shows rotation of a boom microphone of the earpiece device and movement along an adjustable shaft in accordance with some embodiments.

FIG. 3 shows a boom microphone 140 being pivoted in view 302, and FIG. 3 further shows telescoping of the ear loop 130 in view 304 in accordance with some embodiments. Referring to view 302, the swivel boom microphone 140 is coupled to the outer surface of the on-ear speaker housing 110, preferably as a molded piece part. The outer surface of the on-ear speaker housing 110 controls up and down movement of the boom microphone 140. The boom microphone can pivot upwards and downwards about point A 308. If viewed relative to an x, y, z axis 312, the boom microphone 140 may be viewed as rotating through a secondary axis.

Referring to view 304, the adjustable shaft 120 provides a two-way adjustable shaft comprising a shaft pin 310 for vertical movement of the ear loop 130. Point B shows the vertical movement of the earpiece along shaft pin 310. Relative to an x, y, z axis 312, the ear loop 130 moves up and down along the z axis. The vertical movement of the adjustable shaft 120 provides the telescoping control for the ear loop 130.

Figure 4:
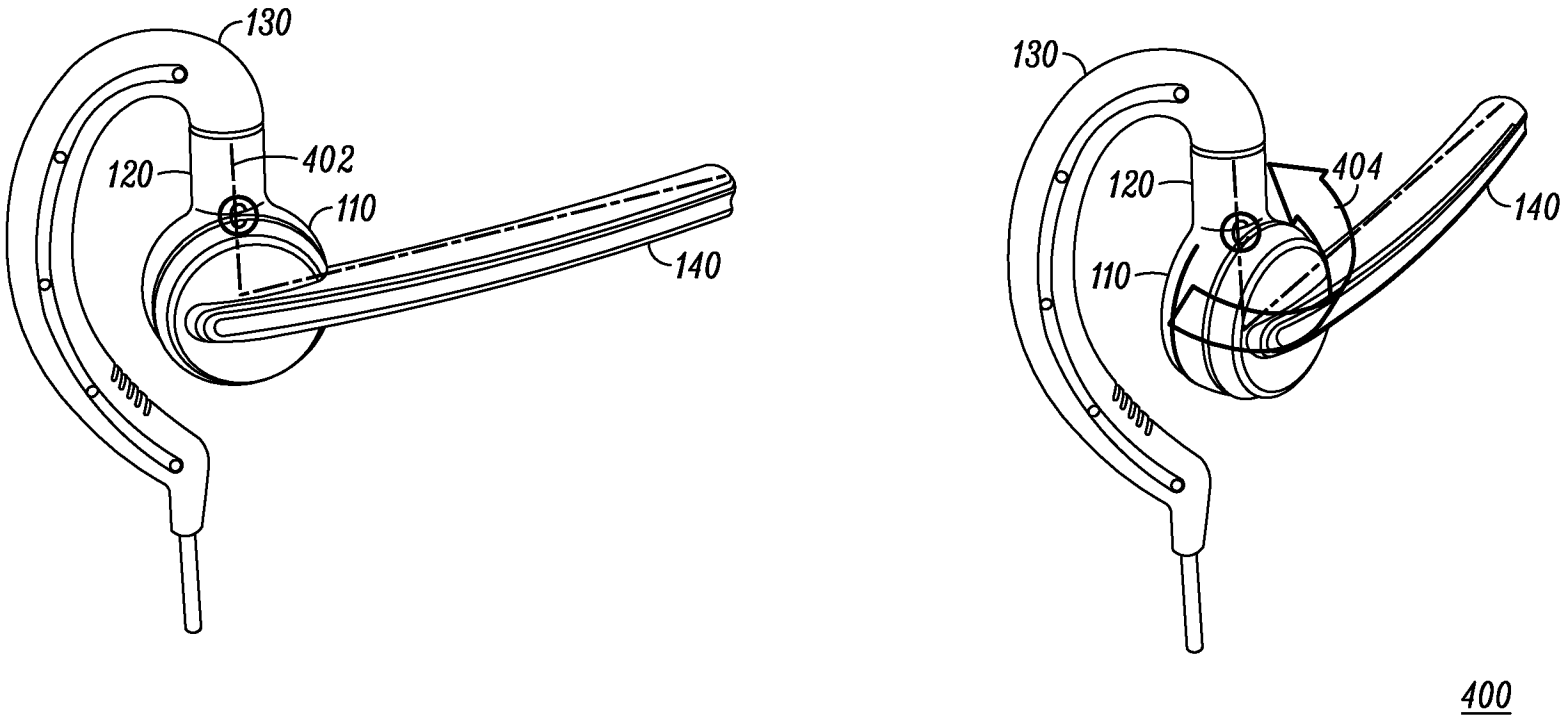
FIG. 4 shows another rotation of a boom microphone of the earpiece device in accordance with some embodiments.

FIG. 4 shows another rotation 400 of boom microphone 140 of the audio device 100 in accordance with some embodiments. The boom microphone swivels at C 402 along a predetermined range of rotation, for example 160 degrees for left to right ear use. The adjustable shaft 120 controls horizontal movement 404 (the left-to-right and right-to-left movement)

of the boom microphone 140. The adjustable shaft 120, on-ear speaker housing 110 and boom microphone all rotate as a single unit. Since the audio device can be worn on either ear, the boom microphone 140 may be curved as its placement is adjustable.

The embodiments of FIGS. 3 and 4 have thus provided for an audio device 100 having an adjustable shaft 120 that adjusts vertical movement of the ear loop 130, and the adjustable shaft adjusts horizontal rotation 404 of the boom microphone 140. The boom microphone 140 comprises a rotating base coupled to the on-ear speaker housing 110 to control up/down rotation or pivoting of the boom microphone.

Figure 5:
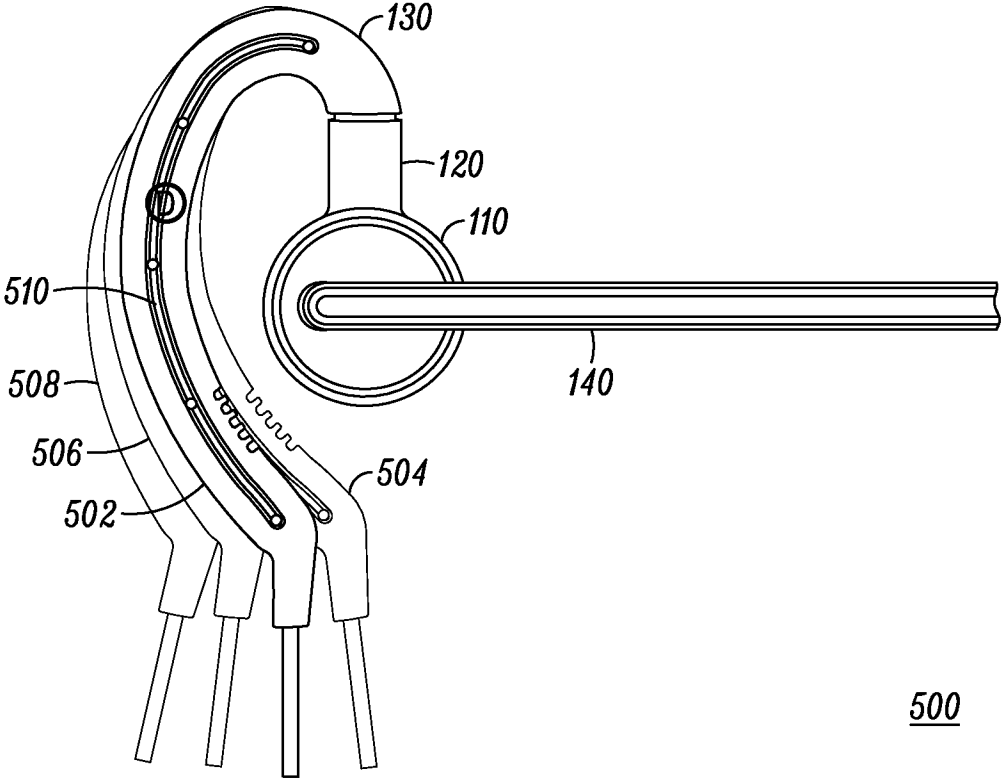
FIG. 5 shows adjustment of an ear loop of the earpiece device in accordance with some embodiments.

FIG. 5 shows adjustment of the malleable ear loop 130 of the audio device 100 in accordance with some embodiments. The ear loop 130 is formed of a flexible rubber material having an insert-molded wire 510 contained therein for customized shaping and positioning of the malleable ear loop. The malleable ear loop 130 can be bent and shaped in a plurality of positions about the ear, shown here as behind the ear positions 502, 504, 506, 508. Electrical wires running from a cable (602 of FIG. 6) may be embedded along the entire length of the ear loop 130 for audio wiring interconnection to another device.

The embodiments of FIGS. 3, 4 and 5 have thus provided for an audio device 100 providing a plurality of adjustable positioning modes or features. Not in any particular order, the first adjustment mode being adjustment of the malleable ear loop 130 shaped to fit about the user's ear, the second adjustment mode being rotation of the shaft for left or right ear usage, the third adjustment mode being up/down movement of the shaft to adjust the ear loop position, the fourth adjustment mode being the up/down position of the boom microphone, and the fifth adjustment mode being horizontal movement of the boom microphone 140 via the shaft. The swivel boom microphone 140 and telescoping malleable ear loop 130 provide adjustability for a wide variety of user preferences.

Figure 6:
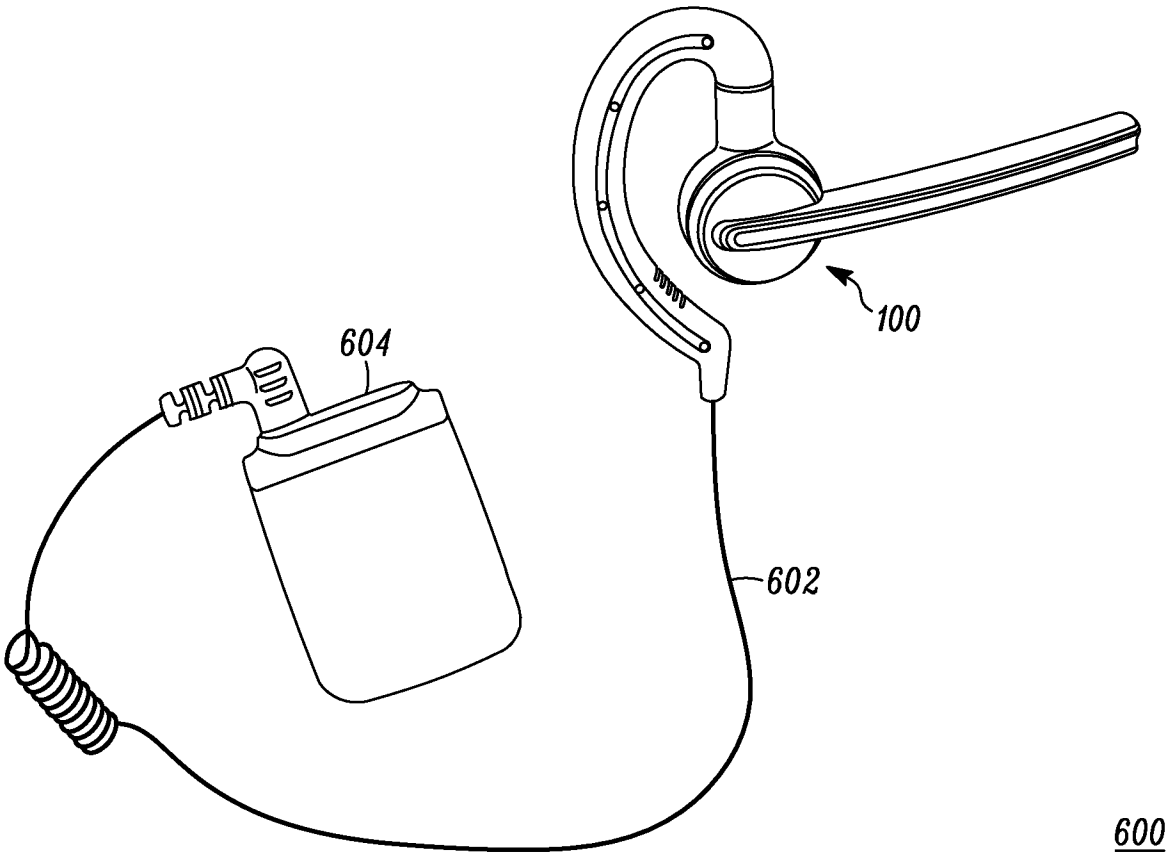
FIG. 6 shows the earpiece device coupled to a remote electronic device in accordance with some embodiments.

FIG. 6 shows the earpiece device coupled to a remote electronic device 604 in accordance with some embodiments. Embedded wiring 602 may run between the remote electronic device 604 along the entire length of ear loop 130 for electrical interconnectivity. The audio device 100 is wearable on either ear of a user by adjustment of the adjustable shaft which controls left-to-right (and right-to-left) rotation of the boom microphone. The audio device 100 provides for the plurality of adjustment modes as previously described for a user friendly customized fit.

Accordingly, there has been provided an audio device 100 which advantageously provides a single system approach that accommodates user-adjustable right or left ear usage. The ear loop is conformable to a variety of shapes via a variety of behind the ear positions along with the ear loop's telescoping capability. The audio device is easy to clean and maintain. Cable routing within the ear loop minimizes tension pull to the speaker housing and inadvertent pull out. The adjustable shaft may further be used to accommodate a swivel boom microphone while still providing right or left ear adjustability.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

I claim:

1. An audio device, comprising:

an on-ear speaker housing having inner and outer surfaces;

an adjustable shaft formed as an extension of the on-ear speaker housing;

a malleable ear loop having a shaft pin extending from one end, the shaft pin further being coupled within the adjustable shaft; and the shaft pin providing two-way vertical movement for the malleable ear loop and the adjustable shaft, the shaft pin being completely insertable within and retractable from the adjustable shaft by pulling on the ear loop.

2. The audio device of claim 1, wherein the adjustable shaft comprises a two-way adjustable shaft for vertical movement of the ear loop and rotation of the on-ear speaker housing.

3. The audio device of claim 1, further comprising:

a swivel boom microphone coupled to the outer surface of the on-ear speaker housing.

4. The audio device of claim 2, further comprising:

a swivel boom microphone coupled to the outer surface of the on-ear speaker housing; and wherein rotation of the on-ear speaker housing rotates the boom microphone.

5. The audio device of claim 1, wherein the malleable ear loop comprises:

flexible rubber material having an insert-molded wire contained therein for customized shaping of the malleable ear loop.

6. The audio device of claim 1, wherein the audio device is wearable on either ear of a user.

7. The audio device of claim 1, wherein the boom microphone swivels through a predetermined range of rotation for left to right ear use.

8. The audio device of claim 1, wherein the boom microphone is curved.

9. The audio device of claim 1, wherein the adjustable shaft controls left-to-right (and right to left) rotation of the boom microphone.

10. The audio device of claim 1, wherein the outer surface of the on-ear speaker housing controls the up and down movement of the microphone boom.

11. The audio device of claim 1, wherein the ear loop is movable vertically up and down using the adjustable shaft.

12. The audio device of claim 3, wherein the adjustable shaft adjusts vertical movement of the ear loop, and the adjustable shaft adjusts horizontal rotation of the boom microphone.

13. The audio device of claim 12, wherein the boom microphone comprises a rotating base coupled to the speaker housing to control up/down movement of the boom microphone.

14. The audio device of claim 3, wherein the audio device provides four adjustment modes, the first adjustment mode being adjustment of the ear loop, the second adjustment mode being rotation of the shaft for left/right (right/left) ear usage, the third adjustment mode being up/down movement of the shaft to adjust the ear loop position, a fourth adjustment mode being the up/down position of the boom microphone, and fifth adjustment mode being horizontal movement of the boom microphone via the shaft.

15. The audio device of claim 1, wherein the ear loop comprises electrical wires embedded along its entire length.

16. An audio device, comprising:

a malleable ear loop having a shaft pin extending therefrom;

an on-ear speaker housing;

an adjustable shaft extending from the on-ear speaker housing and coupled to the malleable ear loop via the shaft pin; and the adjustable shaft providing telescoping of the malleable ear loop via a shaft pin and rotation of the on-ear speaker housing, the shaft pin being completely insertable within and retractable from the adjustable shaft by pulling on the ear loop.

17. The audio device of claim 16, wherein the adjustable shaft provides user adjustable left ear and right ear positioning of the audio device.

18. The audio device of claim 16, further comprising:

a boom microphone rotatably coupled to an outer surface of the on-ear speaker housing.

19. The audio device of claim 18, wherein the boom microphone rotates horizontally about the adjustable shaft and rotates vertically on the outer surface of the speaker housing.

20. The audio device of claim 19, wherein the audio device provides user adjustable left ear and right ear positioning through adjustments to the adjustable shaft and rotation of the boom microphone.

21. The audio device of claim 1, wherein the on-ear speaker housing with adjustable shaft extending thereform is formed as a single molded piece.

22. The audio device of claim 16, wherein the on-ear speaker housing with adjustable shaft extending thereform is formed as a single molded piece.

* * * * *